US010550638B2

(12) United States Patent
Tamez Reyes

(10) Patent No.: US 10,550,638 B2
(45) Date of Patent: Feb. 4, 2020

(54) STEPLADDER ADAPTED FOR USE AS A SINGLE LADDER OR AN EXTENSION LADDER

(71) Applicant: Louisville Ladder Inc., Louisville, KY (US)

(72) Inventor: Francisco Javier Tamez Reyes, Nuevo Leon (MX)

(73) Assignee: LOUISVILLE LADDER INC., Loiuisville, KY (US)

( * ) Notice: Subject to any disclaimer, the term of this patent is extended or adjusted under 35 U.S.C. 154(b) by 299 days.

(21) Appl. No.: 14/935,637

(22) Filed: Nov. 9, 2015

(65) Prior Publication Data

US 2017/0130529 A1 May 11, 2017

(51) Int. Cl.

| | |
|---|---|
| ***E06C 7/50*** | (2006.01) |
| ***E06C 1/18*** | (2006.01) |
| ***E06C 1/12*** | (2006.01) |
| *E06C 7/14* | (2006.01) |
| *E06C 7/48* | (2006.01) |

(52) U.S. Cl.
CPC ..... *E06C 1/18* (2013.01); *E06C 1/12* (2013.01); *E06C 7/50* (2013.01); *E06C 7/14* (2013.01); *E06C 7/48* (2013.01)

(58) Field of Classification Search
CPC ..... E06C 7/48; E06C 1/383; E06C 1/32
USPC ..... 182/67.4, 95, 163, 164, 174–176
See application file for complete search history.

(56) References Cited

U.S. PATENT DOCUMENTS

| | | | | |
|---|---|---|---|---|
| 341,284 | A | 5/1886 | Sharp | |
| 646,347 | A * | 3/1900 | Betty | E06C 1/32 16/326 |
| 1,772,213 | A | 8/1930 | Francois | |
| 2,012,592 | A * | 8/1935 | Skiba | E06C 1/32 182/118 |
| 2,088,878 | A | 8/1937 | Stogner | |
| 2,167,157 | A | 7/1939 | Muehlberg | |
| 2,255,756 | A * | 9/1941 | Biegen | E06C 1/22 182/124 |

(Continued)

FOREIGN PATENT DOCUMENTS

| | | | |
|---|---|---|---|
| DE | 202008012712 | U1 | 12/2008 |
| NZ | 548627 | A | 1/2007 |

OTHER PUBLICATIONS

Third Party Submission made in parent U.S. Appl. No. 16/212,272.

*Primary Examiner* — Daniel P Cahn

(74) *Attorney, Agent, or Firm* — Egbert, McDaniel & Swartz, PLLC

(57) ABSTRACT

A ladder apparatus has a first ladder section having a pair of side rails and a plurality of rungs extending between the side rails, a second ladder section hingedly connected to the first ladder section adjacent an upper end of the first ladder section, and a latch mechanism affixed to one of the ladder sections and engageable with the other of the first and second ladder sections. The second ladder section is movable between an extended position and a retracted position. The latch mechanism is adapted to secure the second ladder section in the retracted position. The second ladder section will extend in generally parallel relation to the first ladder section when in this retracted position. A ladder top is affixed to the upper end of the first ladder section and extends outwardly therefrom so as to have an end surface positioned away from the first ladder section.

8 Claims, 7 Drawing Sheets

(56) References Cited

U.S. PATENT DOCUMENTS 2,521,114 A 9/1950 Campbell
3,084,760 A 4/1963 Lamberti
3,208,553 A 9/1965 Gray
3,313,564 A 4/1967 Pultz
3,447,632 A 6/1969 Boyd
3,631,941 A * 1/1972 Greenman ..... E04G 1/34 182/155
3,643,292 A 2/1972 Mayer
3,700,072 A * 10/1972 Lovett ..... E04G 1/34 182/155
3,744,591 A 7/1973 Lucci et al.
4,053,028 A * 10/1977 Loix ..... E06C 1/20 182/1
4,079,815 A * 3/1978 Cormier ..... B60R 3/02 182/195
4,463,829 A * 8/1984 Grin ..... E06C 1/383 182/108
4,483,415 A * 11/1984 Disston ..... E06C 1/22 182/129
4,489,807 A * 12/1984 Rodriquez ..... E06C 9/085 182/160
4,719,990 A * 1/1988 Markovic ..... E06C 7/44 182/163
4,785,912 A * 11/1988 Lopez ..... E06C 1/383 182/160
4,815,564 A * 3/1989 Yoo ..... E06C 1/32 182/160
5,158,151 A * 10/1992 Chang ..... E06C 1/3835 182/156
5,711,554 A 1/1998 Brown et al.
5,791,437 A * 8/1998 Figliuzzi ..... E06C 1/20 182/107
6,000,497 A * 12/1999 Kain ..... E06C 7/14 182/129
6,138,794 A * 10/2000 Staal ..... E06C 1/32 182/206
6,345,691 B1 2/2002 Ruiz
6,536,557 B2 * 3/2003 Gibson ..... E06C 7/14 182/129
6,698,548 B1 * 3/2004 Verrill ..... E06C 1/39 182/129
7,104,362 B2 * 9/2006 Meeker ..... E06C 1/393 182/161
7,108,103 B2 * 9/2006 Meeker ..... E06C 7/087 182/165
D549,356 S * 8/2007 Gibson ..... D25/68
7,278,515 B2 * 10/2007 Moser ..... E04G 1/28 108/169
7,753,170 B1 * 7/2010 Gibson ..... E06C 7/14 182/107
7,849,967 B2 * 12/2010 Gibson ..... E06C 1/393 182/165
8,215,452 B2 * 7/2012 Stewart ..... B60R 3/02 182/127
9,027,711 B2 * 5/2015 Lonergan ..... E06C 7/50 182/163
2004/0200667 A1 * 10/2004 Babkes ..... B62B 1/002 182/20
2004/0218968 A1 * 11/2004 Beaver ..... E06C 1/32 403/95
2005/0269159 A1 * 12/2005 Lin ..... E06C 1/18 182/209
2006/0054390 A1 * 3/2006 Ray ..... E06C 7/486 182/107
2006/0124397 A1 * 6/2006 Vosbein-Jensen ..... E06C 1/20 182/165
2008/0083583 A1 * 4/2008 Gibson ..... E06C 7/14 182/108
2009/0078503 A1 * 3/2009 Eriksson ..... E06C 1/125 182/18
2009/0133959 A1 * 5/2009 Eriksson ..... E04G 1/34 182/118
2010/0006374 A1 * 1/2010 Gabriel ..... E06C 7/165 182/116
2011/0036666 A1 * 2/2011 Hong ..... E06C 1/12 182/209
2012/0012423 A1 * 1/2012 Murphy ..... E06C 1/383 182/96
2016/0024844 A1 * 1/2016 Neubauer ..... E06C 1/38 182/106
2016/0221510 A1 * 8/2016 Petersen ..... B60R 3/02

* cited by examiner

STEPLADDER ADAPTED FOR USE AS A SINGLE LADDER OR AN EXTENSION LADDER

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to stepladders. More particularly, the present invention relates to the foldable stepladders. Additionally, the present invention relates to stepladders that can be folded so as to be utilized as a single ladder or as an extension ladder.

2. Description of Related Art Including Information Disclosed Under 37 CFR 1.97 and 37 CFR 1.98.

Ladders are commonly used as a means for elevating persons to a specified height in order to perform a specified function. The users of ladders will climb a series of steps, or rungs, in order to reach a desired height. Stepladders are ladders in which a first ladder section extends at an acute angle with respect to a second ladder section. The first ladder section will have the steps or rungs thereon. The second ladder section is intended to provide structural support for the leaning of the first ladder section. As such, stepladders can be used in locations where there is no support surface.

Single ladders require the use of an extrinsic support surface. A single ladder includes a pair of side rails and a plurality of steps, or rungs, extending between the pair of side rails. Typically, the bottom of the stepladder will be placed upon an underlying surface. The single ladder will lean at an acute angle with respect to the underlying surface so as to have an upper end resting against the extrinsic surface.

Extension ladders typically consist of a base section and one or more fly sections with each fly section extendable from the preceding section. The term "base section" is used to refer to the lower of two adjacent sections of an extension ladder, from which a fly section is extended upward. The base section may be the section of the ladder onto which the user first climbs. Typically, with extension ladders, the bottom of the extension ladder will reside on an underlying surface while the fly section extends upwardly and outwardly from the base section so as to have an upper end that rests against an extrinsic surface, such as the side of a building. Extension ladders, in the past, extend linearly and do not have outwardly extending supports therefor.

In the United States and most other countries, it is prohibited lean a closed stepladder against a wall or extrinsic surface for use as a single ladder. The reason is twofold. First, a stepladder is designed to be self-supported on four legs so as to distribute the user's weight across four legs instead of two legs. Secondly, when the closed stepladder would lean against the wall, the other ladder section of the ladder can possibly unfold so as to contact the underlying surfaces and possibly upset the first ladder section. This could potentially cause a slip-out event to occur.

Unfortunately, under those circumstances where different ladders are required, the users are required to purchase a stepladder for one set of purposes and a single or extension ladder for other purposes. Often, the proper type of ladder will not be available when the need for such a ladder occurs. As such, a need has developed whereby a stepladder can be adapted for use as a single ladder or as an extension ladder while still being able to handle all ANSI performance standards as both a four-legged stepladder and also the more stringent loading conditions required of a single ladder. In the past, various patents have issued with respect to such stepladders.

An early patent for a folding stepladder is described in U.S. Pat. No. 341,284, issued on May 4, 1886 to T. P. Sharp. This folding ladder has rungs arranged in pairs. The rungs of each pair are arranged one back of the other end near the upper end of the ladder. A pair of ladder sections are hingedly connected together at the upper end thereof so that one ladder section can fold downwardly so as to extend into a generally inverted V-shape configuration with respect to the other ladder section.

U.S. Pat. No. 1,772,213, issued on Aug. 5, 1930 to B. F. Francois, describes a folding stepladder that includes a bridge member, spaced-apart guides mounted on the bridge member, a ladder unit slidably connected to one of the guides and having foldable steps, and a prop unit slidably connected to the other of the guides. The ladder and the prop units include sections hingedly connected to be folded upwardly. The ladder and prop sections are collapsible respectively at diagonally opposite portions of the guides. As such, the folded sections may be folded laterally of each other.

U.S. Pat. No. 2,088,878, issued on Aug. 3, 1937 to G. H. Stogner, describes a foldable stepladder that includes spaced side members and steps. Each of the side members includes pivotally connected sections pivoted at their outer ends to the side members and adapted to be folded in parallel between the side members. A bar connects all of the steps for folding the steps in unison. Hinges connect the supporting legs to the side members at the upper ends of the side members. Braces are pivoted at one end to the supporting legs and of a second end of the sections of the uppermost step so as to transmit movement of the sections of the step to the supporting legs.

U.S. Pat. No. 2,167,157, issued on Jul. 25, 1939 the K. O. Muehlberg, describes a stepladder that includes a ladder member having side rails and a top platform. Supporting legs are foldably connected to the platform. An elongated arm is slidably mounted through a tapered slot in the top platform and normally disposed in an angle to vertical against the side of the supporting leg. The arm is movable in the slot of the platform to a selected position of the projection extending vertically above the platform.

U.S. Pat. No. 2,255,756, issued on Sep. 16, 1940 to J. M. Bigen, shows a folding stepladder that comprises a primary ladder, an auxiliary ladder positioned to move parallel to the primary ladder, and a means that slidably connects the primary and auxiliary ladders together. A brace is provided for the primary ladder. A pivotally mounted transverse bar connects the lower ends of the brace bars. A platform is secured to the upper end of the auxiliary ladder.

U.S. Pat. No. 3,084,760, issued on Apr. 9, 1963 to B. Lamberti, shows a stepladder with folding elements. The stepladder includes a pair of side rails that are fixed together at the upper ends thereof. Foldable rungs extend between each of the side rails. The foldable run can fold so that the side rails can be position in a folded configuration.

U.S. Pat. No. 3,208,553, issued on Sep. 28, 1965 O. Gray, describes a folding ladder in which a first ladder section is hingedly connected at an upper end thereof to a second ladder section. The first and second ladder sections can extend outwardly so as to be aligned longitudinally in end-to-end relationship. The ladders can be fixed in this end-to-end relationship.

U.S. Pat. No. 3,447,632, issued on Jun. 3, 1969 to C. R. Boyd, discloses a folding tripod-type of ladder in which each of the legs can be folded in a compact configuration so as to support a platform at an upper end thereof.

U.S. Pat. No. 3,744,591, issued on Jul. 10, 1963 to R. Lucci et al., discloses a portable stepladder that has a row of steps supported by side posts and a rear post with an upper end that is pivotally connected to the upper end of the stepladder along a horizontal axis. The stepladder and the rear support are longitudinally split into two sections hinged to one another. Each of the hinged connections lies in a common plane so as to allow the stepladder to be folded up to a closed configuration.

U.S. Pat. No. 4,483,415, issued on Nov. 20, 1984 Disston et al., shows a folding stepladder that includes a lower step section and a strut pivotally connected at the upper ends for swinging movement between a collapsed position, one within the other, and a downwardly divergent erected position. The upper section is pivoted to the upper end of the lower step section for swinging movement between a folded position closely overlying the lower step section and an erected position inclining as an extension of the lower step section.

U.S. Pat. No. 7,849,967, issued on Dec. 14, 2010 to Gibson et al., provides a stepladder that includes a longer inclined frame provided with steps coupled to a shorter stabilizer frame provided with rungs for movement relative to the longer inclined frame between an expanded use position and a collapsed storage position. The stepladder also includes a top-step lock-to-lock for in a fixed position relative to the two frames.

It is an object of the present invention to provide a stepladder apparatus that can function both as a stepladder and a single or extension ladder.

It is another object of the present invention provide a stepladder apparatus in which the stepladder apparatus is able to meet all ANSI performance tests as both a four-legged stepladder and as a two-legged single or extension ladder.

It is another object of the present invention to provide a stepladder apparatus which can be folded into a compact configuration.

It is another object the present invention provide a stepladder apparatus in which one ladder section can be locked to the other ladder section when the ladder sections are closed together.

It is a further object of the present invention to provide a stepladder apparatus in which the second ladder section will lock against the first ladder section when in a single ladder or extension ladder configuration.

It is still another object of the present invention to provide a stepladder apparatus that has a ladder top that facilitates the use of the stepladder apparatus against flat surfaces, wall corners, or against round surfaces.

It is still a further object of the present invention provide a stepladder apparatus that avoids the cost for the user associated with purchasing a single ladder, an extension ladder and a stepladder as separate items.

It is still further object of the present invention to provide a stepladder apparatus that automatically locks when the second ladder section is brought against the first ladder section and which requires manual operation in order to release the ladder sections from their locked configuration.

These and other objects and advantages of the present invention will become apparent from a reading of the attached specification and appended claims.

BRIEF SUMMARY OF THE INVENTION

The present invention is a ladder apparatus that comprises a first ladder section having a pair of side rails and a plurality of rungs extending between the pair of side rails, a second ladder section hingedly connected to the first ladder section adjacent an upper end of the first ladder section, and a latch mechanism affixed to one of the first and second ladder sections and engageable with the other of the first and second latching ladder sections. The second ladder section is movable between an extended position and a retracted position. The latch mechanism is adapted to secure the second ladder section in the retracted position. The first ladder section can be a single ladder or an extension ladder.

The second ladder section is in generally parallel relation with the first ladder section when in the retracted position. A hinge bar is affixed adjacent the upper end of the first ladder section. This hinge bar has an end extending outwardly transverse to the longitudinal axis of the pair of side rails. The second ladder section is pivotally connected to the end of the hinge bar. The first ladder section has a length that is greater than a length of the second ladder section. The second ladder section has a bottom that is positioned at a level above the bottom of the first ladder section when the first and second ladder sections are in the retracted position. A first strut is pivotally connected to the first ladder section in a location between the upper end and the lower end of the first ladder section. A second strut is pivotally connected to the second ladder section in a location between an upper end and a lower end of the second ladder section. The first strut is pivotally connected to the second strut. The first and second struts define the spreader bar between the ladder sections The latch mechanism is a mechanism which automatically locks the second ladder section to the first ladder section when the second ladder section is pivoted so as to be in proximity to the first ladder section. Manual intervention is required so as to release the latch mechanism in order to allow the second ladder section to pivot outwardly with respect to the first ladder section.

In one embodiment of the latch mechanism, the latch mechanism includes a latch bar that is pivotally connected the first ladder section and extends in a direction toward the second ladder section, and a receptacle affixed to the second ladder section. The latch bar is engaged with the receptacle when the second ladder section is in the retracted position. The latch bar has a finger at an end thereof opposite the first ladder section. The finger extends into the receptacle when the second ladder section is in the retracted position. The finger has a tapered surface at the end of the latch bar. The tapered surface rides along a surface of the receptacle as the second ladder section moves toward the retracted position. The latch bar also includes an inset area formed therein on a side of the finger opposite the end of the latch bar. The receptacle has a portion that resides in the inset area when the second ladder section is in the retracted position. The latch bar includes an arm extending outwardly of the first ladder section and in a direction away from the second ladder section. The latch bar is resiliently mounted to the first ladder section such that the latch bar is resiliently urged downwardly. A stop is mounted to the first ladder section adjacent to the latch bar so as to limit a downward movement of the latch bar.

Each of the plurality of side rails of the first ladder section includes a longitudinal channel therein. The second ladder section has another pair of side rails each including a channel therein. The latch bar is pivotally positioned on a support affixed within the longitudinal channel of the first ladder section so as to extend beyond the longitudinal channel and above the sides of the longitudinal channel. The receptacle is affixed within the channel of the second ladder section. The receptacle includes a portion extending outwardly at a level above the sides of the channel of the second ladder section. The latch bar is supported by the outer edges of the sides of the longitudinal channel of the first ladder section.

Within the concept of the present invention, the latch mechanism can be reversed whereby the latch bar is pivotally connected to the second ladder section and extends in a direction toward the first ladder section when the receptacle is affixed within the first ladder section. The latch bar is engaged with receptacle when the second ladder section is in the retracted position.

In another embodiment of the latch mechanism of the present invention, the latch mechanism includes a latch bar that has a first portion attached to one of the first and second ladder sections and a second portion that engages the second ladder section when the first and second ladder sections are brought into proximity. The second portion of the latch bar includes an outwardly extending portion which will allow the user to utilize a hand or a finger so as to manually release the connection between the latch bar and the ladder section such that the ladder sections are free to pivot with respect to each other. Specifically, one embodiment of this latch bar includes a first portion that is mounted upon a support. The support is affixed to within a channel of one of the ladder sections. The support has a square C-shaped structure. The ends of this structure are fastened to the channel. The first portion of the latch bar is affixed to the outwardly extending surface of the structure. This outwardly extending structure is generally flush with the outer ends of the sides of the channel or extends beyond the sides of the channel. The second portion of this embodiment of the latch bar has a hook surface that is received within the channel of the ladder section. Specifically, this hook surface has a V-shaped configuration with an end of the V-shaped configuration facing a side of the channel of the other of the first and second ladder sections. A space is defined between the hook surface and the other side of the channel so as to allow a finger or a hand to extend into the space.

In another embodiment of this latch bar, the first portion is affixed to the channel so as to extend outwardly beyond the sides of the channel. The second portion has a V-shaped configuration with an end facing a side of the channel of the other of the ladder sections. A space is defined between the hook surface and the other side of the channel so as to allow a hand or a finger to extend into the space in order to manually release the second portion from the channel of the other ladder section.

In another embodiment of the latch bar of the present invention, the first portion can either be affixed to the channel of the ladder section or affixed to a support within this channel. The second portion has a hook surface that has a V-shape with a vertex of the V-shape bearing against a side of the channel when the ladder sections are juxtaposed together. An end of the V-shape extends outwardly beyond the side of the channel so as to allow a hand or a finger of the user to separate the vertex of the V-shape from the side of the channel of the other ladder section. When the latch bar is lifted upwardly and away from the other ladder section, the latch bar can be free the connection between the ladder sections so as to allow the ladder sections to pivot with respect to each other.

In any of these embodiments of the latch bar, the latch bar can be of a unitary construction and formed of a strip of steel or aluminum material. This unitary construction significantly reduces the cost associated with the latch mechanism while, the same time, ensuring the integrity of the connection between the ladder sections.

A ladder top is affixed to the upper end of the first ladder section. The ladder top extends outwardly at an obtuse angle with respect to the longitudinal axis of the pair of side rails. This portion of the ladder top has an end surface formed of a rubber or elastomeric material. This portion has a notch formed therein so as to extend inwardly of this end surface. The ladder top is affixed only the upper end of the first ladder section and not to the upper end of the second ladder section.

The present invention is also a method of converting the step ladder into a single or extension ladder, the method includes pivoting the second ladder section relative to the first ladder section such that the second ladder section is juxtaposed against the first ladder section, automatically latching the second ladder section to the first ladder section following the step of pivoting, and leaning the first and second ladder sections against an extrinsic surface such that the first and second ladder sections can act as a single ladder or an extension ladder.

This foregoing Section is intended to describe, with particularity, the preferred embodiments of the present invention. It is understood that modifications to these preferred embodiments can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1:
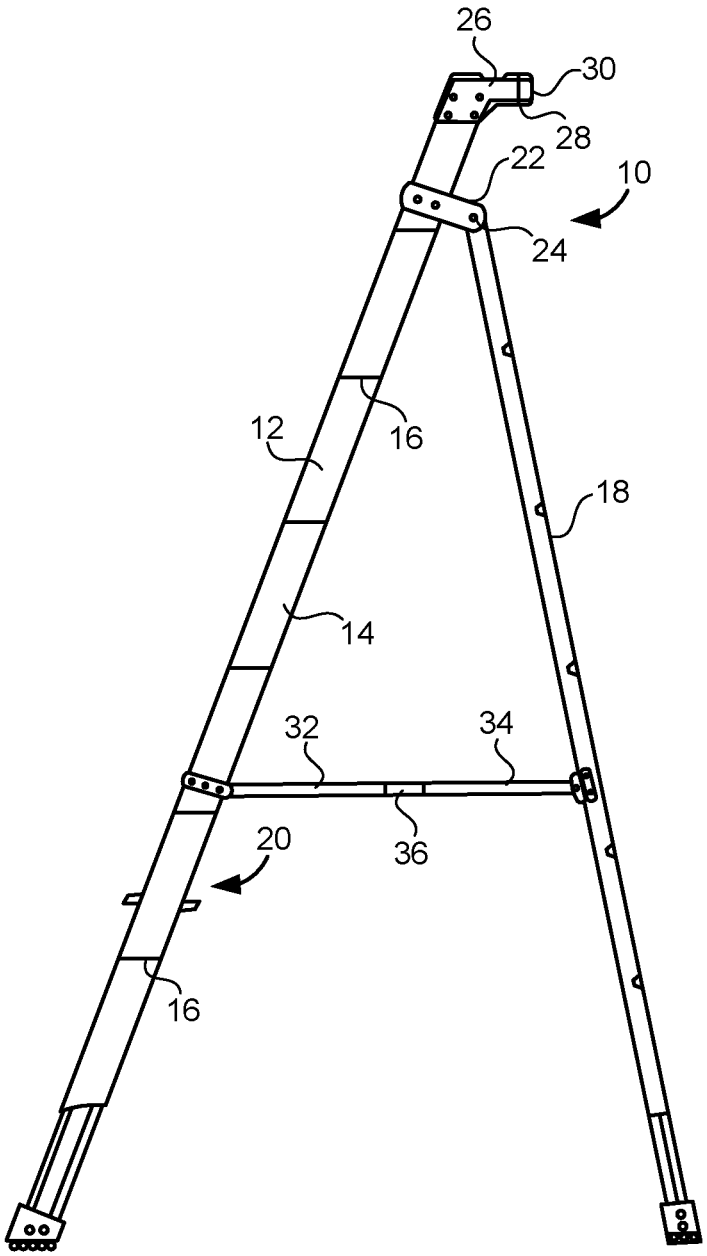
FIG. 1 shows the ladder apparatus the present invention in the extended position and functioning as a stepladder.
Figure 2:
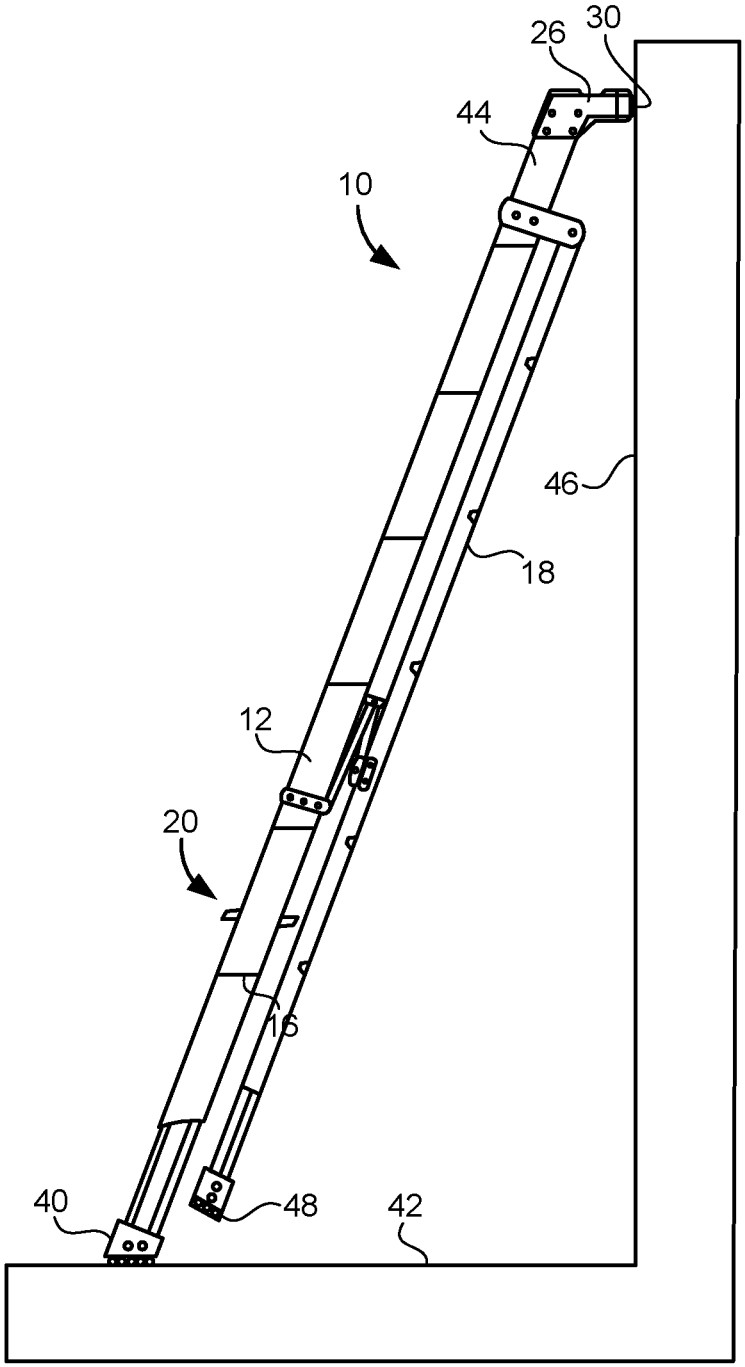
FIG. 2 shows the stepladder apparatus of the present invention in a retracted position and functioning as a single ladder.

Referring to FIG. 1, there shown the ladder apparatus 10 in accordance with the preferred embodiment of the present invention. The ladder apparatus 10 is configured in the form of a stepladder. The ladder apparatus 10 includes a first ladder section 12 which includes a pair of side rails 14 and a plurality of rungs 16 extending between the pair of side rails. A second ladder section 18 is hingedly connected to the first ladder section 12 adjacent an upper end of the first ladder section 12. The second ladder section 18 is configured so as to be movable between an extended position (as shown in FIG. 1) and a retracted position (as shown in FIG. 2). A latch mechanism 20 is affixed to the first ladder section 12 and is engageable with the second ladder section 18 so as to secure the second ladder section 18 in a retracted position against the first ladder section 12.

A hinge bar 22 is affixed to the upper end of the first ladder section 12. The hinge bar 22 includes an end 24 that extends outwardly generally transverse to a longitudinal axis of the side rails 14. The second ladder section 18 is pivotally connected to the end 24 of the hinge bar 22.

In FIG. 1, there is a ladder top 26 that is affixed to the top of the first ladder section 12. As can be seen in FIG. 1, the ladder top 26 includes a portion 28 that extends outwardly from the top of the first ladder section 12 at a generally obtuse angle with respect to the pair of side rails 12. This obtuse angle facilitates the ability for the ladder apparatus 10 to be placed against an extrinsic surface (such as shown in FIG. 2). In particular, the end surface 30 of the ladder top 26 can be formed of a rubber or polymeric or elastomeric material. This is configured so as to avoid any damaging contact with the extrinsic surface. The ladder top 26 is affixed to only the first ladder section 12 since the upper end of the second ladder section 18 is connected to the hinge bar 22 at a location below the ladder top 26. The positioning of the upper end of the second ladder section 18 in a location directly below the outwardly extending portion 28 of the ladder top 26 further facilitates the use of the ladder apparatus 10 in the form of a stepladder. As such, the second ladder section 18 provides strong stability and support for a user that would extend to a location generally above the ladder top 26.

A first strut 32 is pivotally connected to the first ladder section 12 in a location between the upper end and the lower end of the first ladder section 12. A second strut 34 is pivotally connected to the second ladder section 18 in a location between the upper end and the lower end of the second ladder section. It can be seen that the first strut 32 is pivotally connected at 36 to the second strut 34. This pivotal connection will facilitate a scissors-like movement of the struts 32 and 34 so as to maintain the struts 32 and 34 in a linear orientation when the ladder apparatus 10 is in the stepladder configuration while facilitating the ability to fold the second ladder section 18 with respect to the first ladder section 12 when the ladder apparatus 10 assumes the single or extension ladder configuration (as shown in FIG. 2). The struts 32 and 34 serve as the spreader bar between the first ladder section 12 and the second ladder section 18.

FIG. 2 shows the ladder apparatus 10 in its retracted position. In particular, in FIG. 2 the first ladder section 12 has its lower end 40 resting upon a floor (or other underlying surface) 42. The first ladder section 12 extends upwardly at an acute angle with respect to the floor 42 so as to have an upper end 44 positioned adjacent to a wall 46 (or other extrinsic surface). The ladder top 26 has its end surface 30 bearing against the wall 46. As such, the ladder apparatus 10 is illustrated in its configuration is functioning as a single ladder.

So as to enhance the structural integrity of the ladder apparatus 10 and to avoid those problems caused by the swinging or releasing of the second ladder section 18, the lock mechanism 20 is engaged with the second ladder section 18 so as to maintain the second ladder section 18 adjacent to the first ladder section 12 in a generally parallel relationship with the first ladder section 12. As such, this will prevent the lower end 48 of the second ladder section 18 from swinging outwardly so as to contact the floor 42 and cause a possible dislodgment of the bottom 40 of the first ladder section 12.

The first ladder section 12 of the ladder apparatus 10 of the present invention is formed of an extremely strong structural material such that the first ladder section, individually, can meet ANSI performance tests as two-legged single or extension ladder. This will serve to satisfy all require all ANSI performance requirements for use of the ladder apparatus 10 has a four-legged stepladder. This in inherently satisfies the ANSI performance tests since the user's weight would be distributed across all four legs when the apparatus 10 functions as a stepladder (as shown in FIG. 1).

Figure 3:
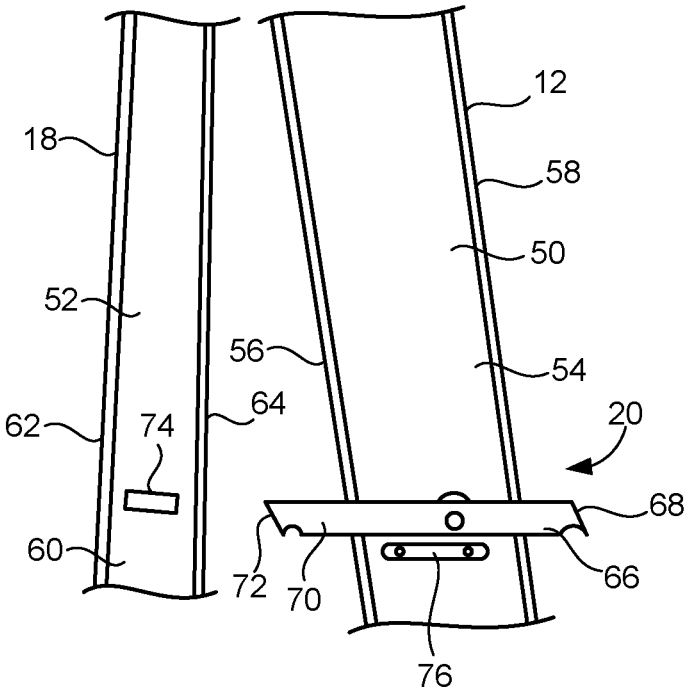
FIG. 3 is a detailed view showing the latch mechanism of the present invention in which the first and second ladder sections are in the extended position.

FIG. 3 illustrates a first embodiment of the latch mechanism 20 as used on the ladder apparatus 10 of the present invention. In particular, FIG. 3 shows a side rail 50 of the first ladder section 12 and shows a side rail 52 of the second ladder section 18. The side rail 50 of the first ladder section 12 includes a channel 54 formed therein and defined by sides 56 and 58. As such, the channel 54 is a U-shaped channel. Similarly, the side rail 52 of the second ladder section 18 includes a channel 60 that is formed with sides 62 and 64.

The latch mechanism 22 includes a latch bar 66 that is pivotally mounted to the side rail 54 of the first ladder section 12. The latch bar 66 includes an arm 68 that extends outwardly beyond the side 58 of the channel 54. The latch bar 66 includes a portion 70 that extends outwardly beyond the side 56 of the channel 54 and in a direction toward the side rail 52 of the second ladder section 18. A finger 72 is formed at the end of the latch bar 66. The side rail 52 of the second ladder section 18 has a receptacle 74 formed therein. The receptacle 74, as will be described hereinafter, is an inverted U-shape member that has its free ends affixed to the side rail 52 within the channel 60.

A stop 76 is positioned below the latch bar 66 within the channel 54 of side rail 50. Stop 76 serves to limit a downward movement of the latch bar 66. The latch bar 66 is resiliently mounted so as to be urged in a downward direction. The arm 68 allows the user to overcome this downward urging by pressing downwardly of the arm 68. As will be described hereinafter, a downward pressing of the arm 68 will allow the finger 72 to be freed from receipt within the receptacle 74.

Figure 4:
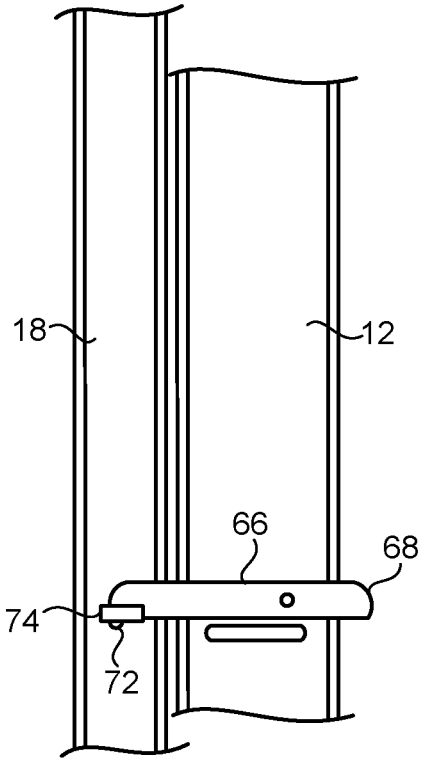
FIG. 4 shows the latch mechanism of the present invention in which the first and second ladder sections are in the retracted position.

FIG. 4 illustrates the first ladder section 12 and the second ladder section 18 in which the second ladder section 18 is in its retracted position. In this configuration, it can be seen that the latch bar 66 has the finger 72 inserted within the receptacle 74. The resilient urging of the latch bar 66 to this lower position will retain the finger 72 within the receptacle 74 and, as such, the second ladder section 18 will remain in juxtaposition against the first ladder section 12. When it is desired to release this connection, a downward force can be placed upon the arm 68 so that the finger 72 travels upwardly and becomes free of the receptacle 74.

Figure 5:
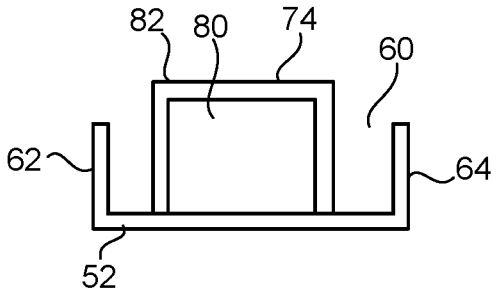
FIG. 5 is an end view of the side rail of the second ladder section showing a receptacle as mounted within the second ladder section.

FIG. 5 illustrates the receptacle 74 as positioned within the channel 60 of the side rail 52 of the second ladder section 18. In particular, the side rail 52 includes sides 62 and 64 that extend upwardly. The receptacle 74 is a square inverted U-shape configuration so as to define an interior 80. The finger 72 of the latch bar 66 will be retained within this interior 80 of the receptacle 74. The outer surface 82 of the receptacle 74 is located beyond the upper edges of the sides 62 and 68. As such, the interior 80 will be available for tight receipt of the finger 72 in the space within the interior 80 of the receptacle 74 beyond the upper edges of the sides 62 and 64.

Figure 6:
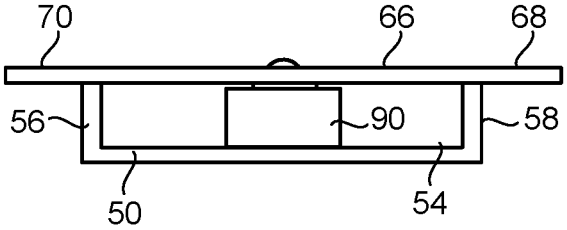
FIG. 6 is an end view showing a channel of the first ladder section and showing the latch mechanism as positioned within this channel.

FIG. 6 shows the latch bar 66 as placed within the side rail 50 of the first ladder section 12. The side rail 50 includes sides 56 and 58. A support 90 is positioned within the channel 54 defined by the sides 56 and 58. In particular, the latch bar 66 will be rotatably mounted to the support 90. The latch bar 66 is in the nature of a planar member that extends slightly outwardly and beyond the upper edges of the sides 56 and 58. As such, the portion 70 of latch bar 66 extends outwardly of the side 56. The arm 68 of the latch bar 66 extends outwardly beyond the side 58. Sides 56 and 58 are juxtaposed against the inner surface of the latch bar 66 so as to provide structural support thereto.

Figure 7:
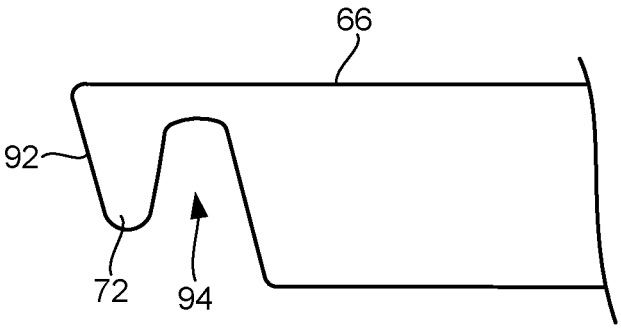
FIG. 7 is a detailed view showing the end of the latch bar of the latch mechanism of the present invention.

FIG. 7 shows the configuration of the end of the latch bar 66. In particular, the finger 72 includes a tapered surface 92 and an inset area 94. The tapered surface 92 at the end of the latch bar 66 can contact the outer surface of the receptacle 74 when the second ladder section 18 is moved toward the first ladder section 12. The tapered surface 92 will ride along the exterior surface of the receptacle 74 until the upper surface of the receptacle 74 passes along the curved surface at the bottom of the tapered surface 72. As such, the side of the receptacle 74 will enter the inset area 94 and the finger 72 will enter the interior 80 of the receptacle 74. This configuration assures that the second ladder section 18 will be securely locked against the first ladder section whenever the second ladder section 18 is in its retracted position. The resilient mounting of the latch bar 66 will create enough downward pressure so that the finger 72 will be locked into the receptacle 74 regardless of the orientation of the ladder apparatus 10. It is only when enough force is applied to the arm 68 that this connection is released and the second ladder section 18 is allowed to pivot away from the first ladder section 12.

Figure 8:
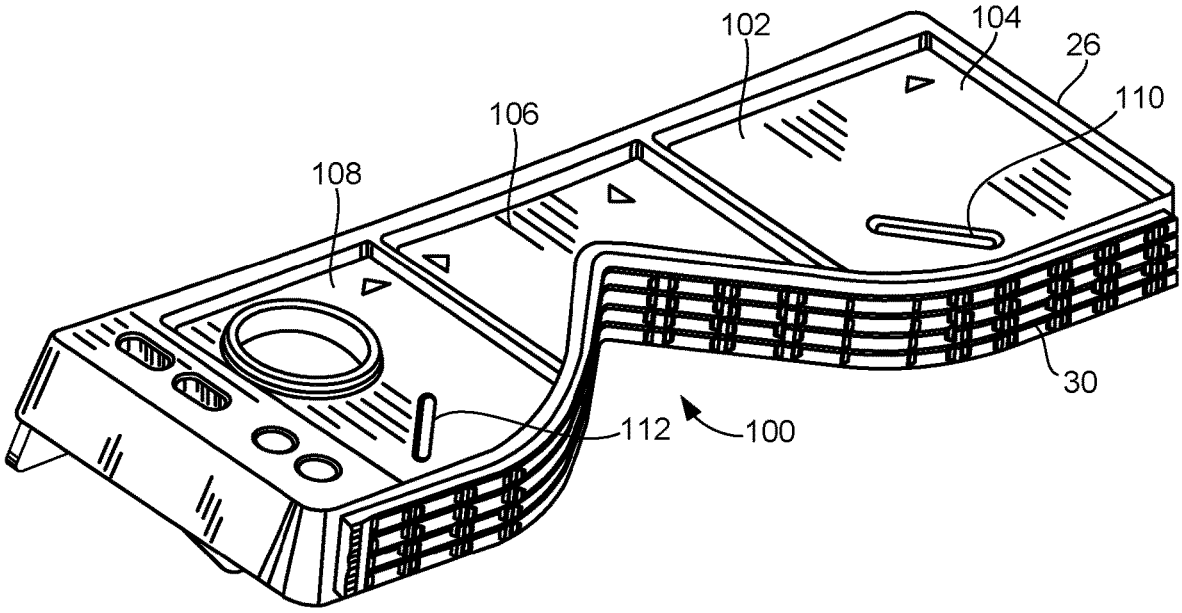
FIG. 8 is a perspective view showing the ladder top as used on the ladder apparatus of the present invention.

According to FIG. 8, there is shown the ladder top 26 in accordance with the teachings of the present invention. Ladder top 26 resembles the ladder top that is described in U.S. Pat. No. 7,753,170 by the present applicant. This ladder top 26 includes an end surface 30 that has a V-shaped indentation 100. The end surface 30 can be formed of a polymeric material, rubber material, or an elastomeric material. As such, this avoids possible damaging contact with the extrinsic surface, such as the wall shown in FIG. 2. The ladder top 26 has a top surface 102 that includes trays 104, 106 and 108 therein. Slots 110 and 120 are formed through the top surface 102. Slots 110 and 112 facilitate the ability to insert straps in order to secure the ladder top 26 to an object, such as a pole, a tree, or other sort of upwardly extending member. The top surface 26 can also include a variety of holes used for retaining tools the area and a pocket for receiving items, such as nails, bolts or screws.

As was described hereinbefore, the end surface 30 will extend outwardly for a significant distance away from the upper end of the first ladder section 12. The end surface 30 includes several ridges, longitudinal channels in vertical channels so as to enhance the ability to retain the ladder top 26 against the extrinsic surface.

Figure 9:
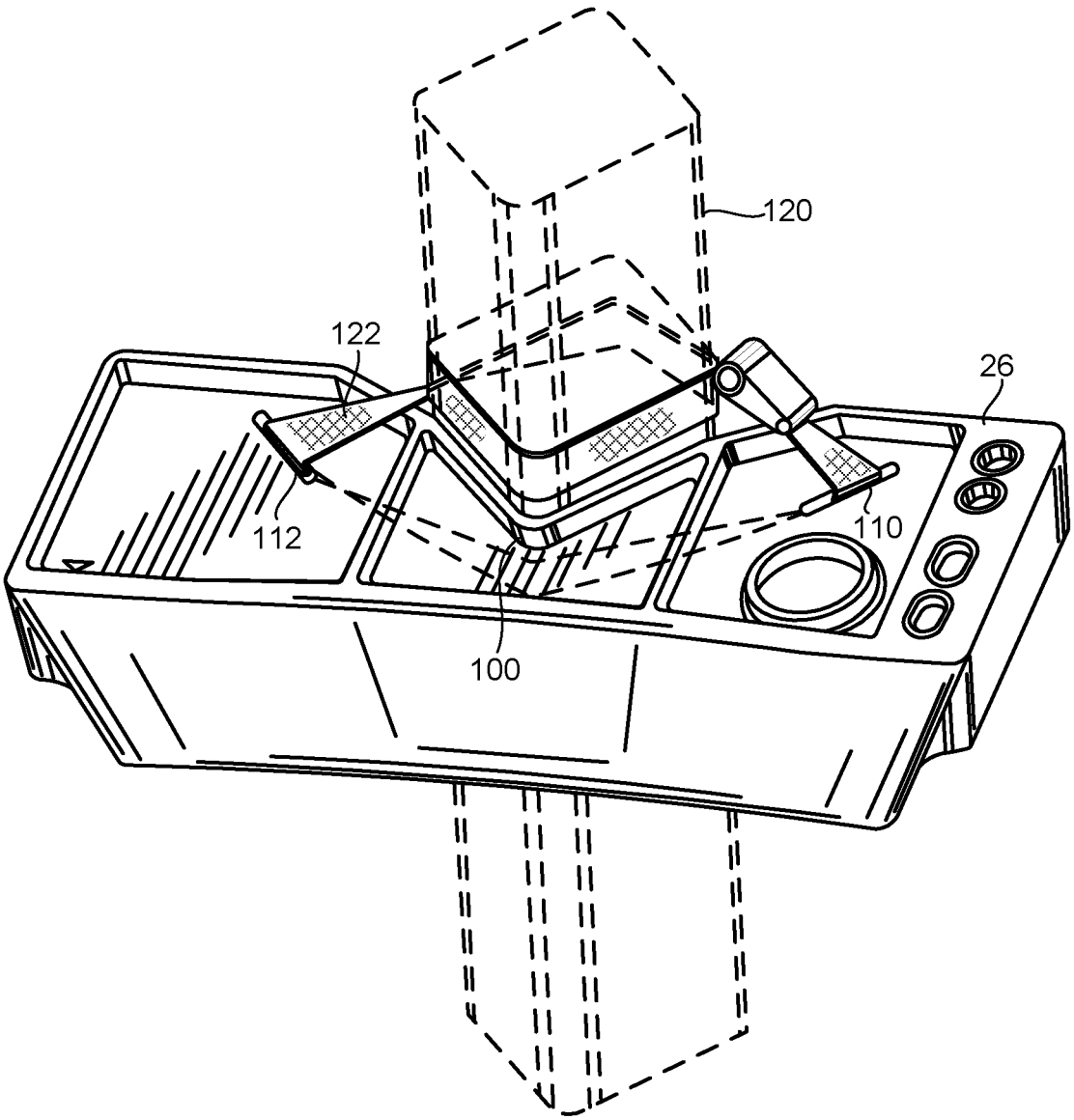
FIG. 9 is an illustration of the ladder top as used on the ladder apparatus of the present invention and as placed against an irregular surface.

FIG. 9 illustrates the ladder top 26 as secured to an extrinsic surface such as pole 120. It can be seen that a pole 120 is received within the V-shape slot 100. A strap 122 has been placed through the slots 110 and 112. The strap 122 will serve to wrap around the pole 120. As such, the ladder top 26 can be securely retained against an irregular-shaped vertically-extending object, such as a pole or a tree.

Figure 10:
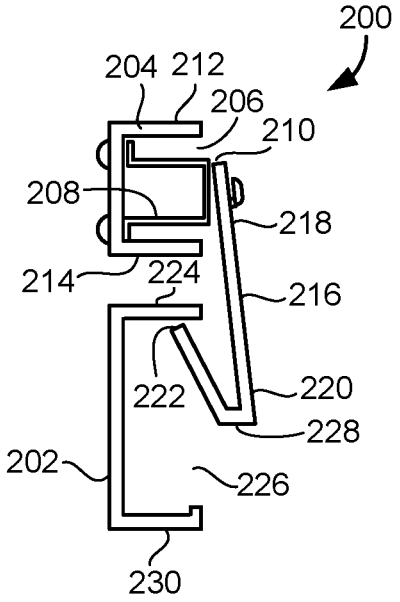
FIG. 10 is a cross-sectional-sectional plan view showing a second embodiment of the latch bar of the present invention.

Referring to FIG. 10, there is shown a second embodiment of the latch mechanism 200 as used in the present invention. The latch mechanism 200 is used in association with the first ladder section 202 and the second ladder section 204. The second ladder section 204 has a channel 206 therein. Channel 206 is of a square U-shaped configuration. In particular, a support 208 is provided having a square C-shaped configuration with the ends affixed to the wall of the channel 206. The support 208 includes a surface 210 that extends beyond the sides 212 and 214 of the channel 206. This surface 210 can also be flush with or slightly recessed within the sides 212 and 214. A latch bar 216 is provided having a first portion 218 that is mounted to the surface 210 of the support 208. The latch bar 216 has a second portion 220 of the capital V-shaped configuration which extends outwardly from the second ladder section 204 toward the first ladder section 202. When the first ladder section 202 is moved into a position juxtaposed against or adjacent the second ladder section 204, the end 222 of the second portion 220 will face one side 224 of the channel 226 of the first ladder section 204. As such, if there is an attempt to move the first ladder section 202 away from the second ladder section 204, this movement is blocked by the end 222 of the second portion 220 of the latch bar 216. The latch bar 216 is of a unitary construction and, preferably, formed of a steel or aluminum material. A space is defined between the vertex 228 of the second portion 220. As such, the user can insert a finger or a hand into the space between this vertex 228 and the side 230 of the channel 226. A lifting motion will cause the end of 222 to separate from the channel 226 in order to allow for the movement of the first ladder section 202 with respect to the second ladder section 204. Within this embodiment of the latch mechanism 200 of the present invention, the positions of the first portion and the second portion of the latch bar 216 can be reversed between the first and second ladder sections.

Figure 11:
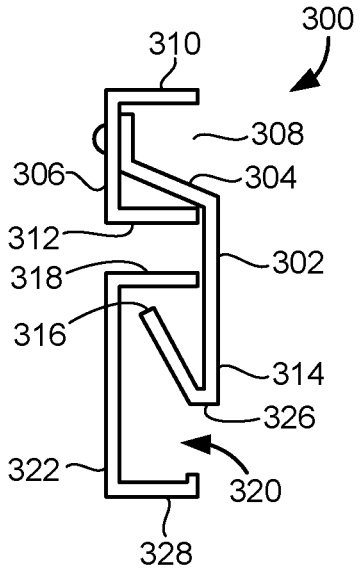
FIG. 11 is a cross-sectional plan view showing a third embodiment of the latch bar of the present invention.

FIG. 11 shows a third embodiment of the latch mechanism 300 of the present invention. Latch mechanism 300 include a latch bar 302 that has a first portion 304 mounted against the wall 306 of the channel 308 of the second ladder section 310. This first portion 304 will extend outwardly from the wall 306 so as to extend beyond the end of the side 312 of the first ladder section 310. The latch bar 302 also includes a second portion 314 that extends outwardly from the first portion 304. The second portion 314 has a V-shaped configuration. As can be seen, an end 316 of the second portion 314 faces the side 318 of the channel 320 of the first ladder section 322. As such, any movement between the first ladder section 310 and the second ladder section 322 will be resisted by contact between the end 316 and the side 318. In order to release the latch bar 312 from this locking position, it is only necessary for the user to insert his or her finger into the space between the vertex 326 of the second portion 314 of latch bar 302 and the side 328 of the first ladder section 322. A lifting motion will free the end 316 from the channel 320 so that the first ladder section 322 can be pivoted with respect to the second ladder section 310. The relative positions of the first portion 304 and the second portion 314 of the latch bar 302 can be reversed between the first ladder section 322 in the second ladder section 314 in accordance with the teachings of this third embodiment of the latch mechanism 300 of the present invention.

Figure 12:
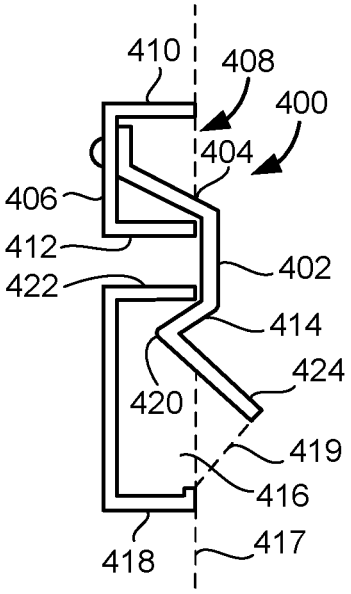
FIG. 12 is a cross-sectional plan view showing a fourth embodiment of the latch part of the present invention.

FIG. 12 shows a fourth embodiment of the latch mechanism 400 in accordance with the present invention. The latch mechanism 400 includes a latch bar 402 that has a first portion 404 that is attached to the wall 406 of the channel 408 of the second ladder section 410. The first portion 404 will extend outwardly at an angle so as to extend beyond the side 412 of channel 408. This portion 404 of the latch bar 402 will extend outwardly so as to have the second portion 414 positioned within the channel 416 of the first ladder section 418. The second portion 414 is of an V-shaped configuration so as to have an inwardly inclined portion residing within the channel 416. A vertex 420 of this V-shaped configuration can ultimately bear against a wall 422 of the first ladder section 418. This V-shaped configuration of the second portion 414 includes an arm 424 that extends outwardly beyond a plane 417 (shown in broken lines) extending across ends of the sides of channel 416 of the first ladder section 418 so as to provide a space 419 (shown in broken lines) whereby the user can use his or her fingers so as to manipulate the latch bar 402 so as to separate the latch bar 402 from the channel 416 of the first ladder section 418. Within the concept of this fourth embodiment of the latch mechanism 400, the first portion 404 can be mounted upon a support in the manner shown in FIG. 10. Additionally, the relative positions of the first portion 404 and the second portion 414 can be reversed between the first ladder section 418 and the second ladder section 410.

In either of the embodiments of FIGS. 10-12, the latch bar is of a unitary construction and formed of a metal material, such as steel or aluminum. In each of these configurations, the engagement of the second portion with the wall of the channel assures that the ladder sections will not unintentionally separate from each other. The latch mechanism of FIGS. 10-12 is of a relatively inexpensive configuration and can be easily manufactured in association with the ladder apparatus of the present invention.

Within the concept of the present invention, it can be seen from the previous figures that the latch mechanism is actually applied to the ladder sections. Within the concept of the present invention, it is possible that the latch mechanism can be utilized in association with the spreader bar so as to secure the ladder sections together.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A ladder apparatus comprising:

a first ladder section having a pair of side rails and a plurality of rungs extending between said pair of side rails;

a second ladder section hingedly connected to said first ladder section adjacent an upper end of said first ladder section, said second ladder section being movable between an extended position and a retracted position, said second ladder section being juxtaposed against said first ladder section in said retracted position, said second ladder section being pivoted outwardly in said extended position such that said first ladder section and said second ladder section are in an inverted V-shaped configuration such that a bottom-most portion of the first ladder section is configured to be supported on a flat ground surface as a bottom-most portion of the second ladder section is also supported on the flat ground surface; and a latch mechanism cooperative with said first and second ladder sections so as to automatically secure said second ladder section in said retracted position, said latch mechanism comprising:

a latch bar having a first portion and a second portion, said latch bar being entirely formed of a single piece of material, said first portion mounted to an inner wall of a channel of one of said first and second ladder sections, said second portion extending into a channel of another of said first and second ladder sections when said second ladder section is in the retracted position, said second portion of said latch bar having an end extending outwardly beyond a plane extending across ends of opposite sides of the channel of said another of said first and second ladder sections, said second portion of said latch bar defining a space with respect to one of the sides of the channel of said another of said first and second ladder sections, the space allowing a finger to engage with said second portion of said latch bar.

2. The ladder apparatus of claim 1, said second ladder section being in generally parallel relation to said first ladder section when said second ladder section is in said retracted position.

3. The ladder apparatus of claim 1, further comprising:

a hinge bar affixed adjacent said upper end of said first ladder section, said hinge bar having an end extending outwardly transverse to a longitudinal axis of said pair of side rails, said second ladder section being pivotally connected to said end of said hinge bar.

4. The ladder apparatus of claim 1, said first ladder section having a greater length than a length of said second ladder section.

5. The ladder apparatus of claim 1, said second ladder section having a bottom that is positioned at a level above a bottom of said first ladder section when said second ladder section is in said retracted position.

6. The ladder apparatus of claim 1, further comprising:

a first strut pivotally connected to said first ladder section in a location between said upper end and a lower end of said first ladder section; and a second strut pivotally connected to said second ladder section in a location between an upper end and a lower end of said second ladder section, said first strut being pivotally connected to said second ladder section.

7. The ladder apparatus of claim 1, said latch mechanism being manually releasable to allow said second ladder section to move to the extended position.

8. The ladder apparatus of claim 1, said first ladder section being an extension ladder.

* * * * *